US011388971B2

(12) United States Patent
Lavoie

(10) Patent No.: US 11,388,971 B2
(45) Date of Patent: Jul. 19, 2022

(54) TRAVEL STRAP SYSTEM

(71) Applicant: Sylvie Cecile Lavoie, Canmore (CA)

(72) Inventor: Sylvie Cecile Lavoie, Canmore (CA)

( * ) Notice: Subject to any disclaimer, the term of this patent is extended or adjusted under 35 U.S.C. 154(b) by 286 days.

(21) Appl. No.: 16/596,884

(22) Filed: Oct. 9, 2019

(65) Prior Publication Data

US 2021/0106112 A1 Apr. 15, 2021

(51) Int. Cl.
*A45C 13/30* (2006.01)

(52) U.S. Cl.
CPC ..... *A45C 13/30* (2013.01); *A45C 2013/306* (2013.01)

(58) Field of Classification Search
CPC ..... A45C 13/30; A45C 2013/306
USPC ..... 224/580, 627, 150, 579
See application file for complete search history.

(56) References Cited

U.S. PATENT DOCUMENTS 1,327,680 A * 1/1920 Leahy ..... A45C 13/30 294/153
3,023,941 A * 3/1962 Foley ..... A45F 5/12 224/604
3,865,292 A * 2/1975 Foley ..... B65D 63/18 294/149
5,016,797 A * 5/1991 Rowledge ..... A45F 5/00 224/257
5,083,692 A 1/1992 Treese
5,370,286 A 12/1994 Newman
5,429,288 A 7/1995 Sattler
5,501,308 A 3/1996 King
5,829,559 A 11/1998 Nordstrom et al.
6,371,346 B1 4/2002 Sharma
8,998,052 B1 * 4/2015 Mitchell ..... A45F 3/14 224/660
2004/0094592 A1 5/2004 Brown
2006/0102672 A1 5/2006 Godshaw
2007/0062012 A1 * 3/2007 Caison ..... A44B 11/263 24/302
2007/0228228 A1 10/2007 Korbonski
2008/0041905 A1 2/2008 Cavett
2008/0127461 A1 6/2008 Linden et al.
2009/0057358 A1 * 3/2009 Cheesman ..... A45C 13/30 224/250

(Continued)

FOREIGN PATENT DOCUMENTS

DE 4015606 A1 11/1991

*Primary Examiner* — John K Fristoe, Jr.
*Assistant Examiner* — Justin Caudill
(74) *Attorney, Agent, or Firm* — Argus Intellectual Enterprise; Daniel Enea; Jordan Sworen

(57) ABSTRACT

A travel strap system for securing items to one another for convenient carrying while traveling. The travel strap system includes a container strap extending from a main strap, wherein the container strap is attached to a first end of the main strap and a coupling member extends from a second end of the main strap. The coupling member can receive an object and automatically adjust to a size of the object disposed therein. Each of the ends of the main strap include a fastener securable to a secondary strap or an accessory strap in order to secure more items within the system. The accessory strap includes a pair of coupling members suspended between a first end and a second end thereof. In some embodiments, each coupling member includes a loop member and a ring, wherein the ring is freely movably along the loop member.

7 Claims, 4 Drawing Sheets

(56) References Cited

U.S. PATENT DOCUMENTS

| | | | | |
|---|---|---|---|---|
| 2011/0056051 | A1* | 3/2011 | Wilkinson | H02G 3/30 24/302 |
| 2013/0212898 | A1 | 8/2013 | Reynolds | |
| 2013/0221047 | A1 | 8/2013 | Johnson | |
| 2014/0014243 | A1* | 1/2014 | Phillips | A45C 13/30 150/106 |
| 2014/0224389 | A1 | 8/2014 | Iwai | |
| 2015/0144670 | A1* | 5/2015 | Millington | A45C 13/30 224/250 |
| 2017/0009394 | A1 | 1/2017 | Durney et al. | |

* cited by examiner

TRAVEL STRAP SYSTEM

BACKGROUND OF THE INVENTION

The present invention relates to a travel strap system. More specifically, the present invention relates to a travel strap system having a main strap connected to a container strap, wherein each end of the main strap is removably securable to a secondary strap.

Many people travel for work, pleasure or both for days or weeks at a time, requiring advance packing preparation for various activity, weather, and the like. Having to travel with luggage, umbrellas, coats, coffee mugs, water bottles, neck pillows of various sizes, among other objects, as well as carrying on one's person laptop computers, tablets, and other electronic devices is burdensome and causes physical strain on the body. Additionally, travel between obligations throughout the day requires people to leave their home and travel with items such as a briefcase, gym bag, lunch sack, books, coats, and the like. This either requires multiple trips to and from a vehicle or overburdening one's body by having to carry everything at once, causing strain and resulting in dropped items along the way.

In view of the above concerns, it is desirable to provide an embodiment of a travel strap system that includes a main strap configured to secure to a secondary strap on either end thereof for securing multiple type baggage and objects to one another for convenient travel. Particularly, it is desirable to provide the travel strap system having a container strap secured to the main strap for securing book and tablets thereto. Further, there is a need for a system of modular straps and attachment devices, such as fasteners and loops, that are selectively reconfigurable to secure a wide range of accessories and travel equipment.

In light of the devices disclosed in the known art, it is submitted that the present invention substantially diverges in design elements and methods from the known art and consequently it is clear that there is a need in the art for an improvement for a travel strap system. In this regard the instant invention substantially fulfills these needs.

SUMMARY OF THE INVENTION

In view of the foregoing disadvantages inherent in the known types of travel strap systems now present in the known art, the present invention provides a new travel strap system for receiving multiple other objects therein and securing to luggage for convenient carrying and travel.

It is an objective of the present invention to provide a travel strap system comprising a container strap extending from a main strap, wherein the container strap is attached to a first end of the main strap and a coupling member extends from a second end of the main strap. The coupling member is configured to receive an object therethrough automatically adjust to a size of the object disposed therein. Each of the ends of the main strap include a fastener securable to a secondary strap or an accessory strap in order to secure more objects within or to the system. The accessory strap includes a pair of coupling member suspended between a first end and a second end thereof. In some embodiments, each coupling member forming a loop and a ring, wherein the ring is freely movably within the loop.

It is therefore an object of the present invention to provide a new and improved travel strap system that has all of the advantages of the known art and none of the disadvantages.

Other objects, features and advantages of the present invention will become apparent from the following detailed description taken in conjunction with the accompanying drawings.

BRIEF DESCRIPTIONS OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
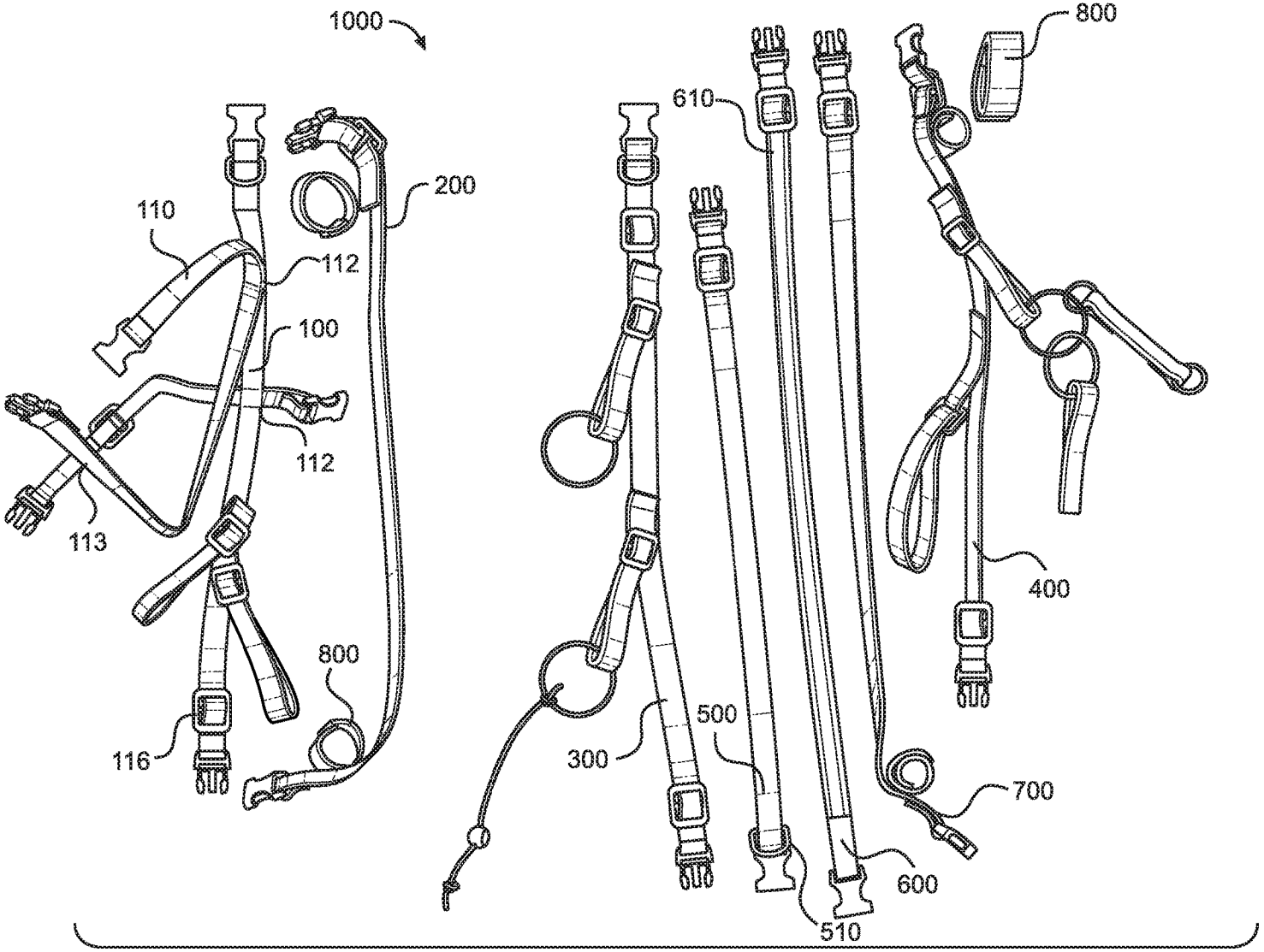
FIG. 1 shows a perspective view of an embodiment of the travel strap system.

Reference is made herein to the attached drawings. Like reference numerals are used throughout the drawings to depict like or similar elements of the travel strap system. For the purposes of presenting a brief and clear description of the present invention, the preferred embodiment will be discussed as used for receiving multiple objects and securing to luggage and the like. The figures are intended for representative purposes only and should not be considered to be limiting in any respect.

Referring now to FIG. 1, there is shown a perspective view an embodiment of the travel strap system. The travel strap system 1000 provides a modular series of straps and attachment devices, such as fasteners and loops, that are selectively reconfigurable to secure a wide range of accessories and travel equipment. The travel strap system 1000 comprises a main strap 100 having a first end 130 and a second end 135. Each end 130, 135 of the main strap 100 includes a fastener securable to a secondary strap 200, 500, 600, 700 and/or an accessory strap 300, 400 in order to secure more objects within or to the strap system. In this way, the travel strap system provides various configurations with only a limited number of straps that are adapted to affixed to each other.

The travel strap system further comprises one or more band attachment member 800 that are adapted to attach the main strap 100, the secondary straps 200, 500, 600, 700, or the accessory straps 300, 400 to travel bags, back packs, golf bags and purses to carry extra belongings—pillows, scarfs, books, jackets, and the like. The travel strap system 1000 is configured to secure personal items together while allowing for easy access thereof. In the illustrated embodiment, the main strap 100 is adjustable in length via a length adjusting mechanism 116, such as a slide buckle. In the illustrated embodiment, the travel strap system are composed of nylon. However, in alternate embodiments, the main strap is composed of any flexible and durable material.

In the illustrated embodiment, the travel strap system 1000 comprises a plurality of secondary straps including: a first secondary strap 200, a second secondary strap 500, a third secondary strap 600, and a fourth secondary strap 700. Each secondary strap 200, 500, 600, 700 comprises a first end and a second end, wherein each end is configured to secure to a mating fastener. In the illustrated embodiment, a female buckle is disposed on the first end and a male buckle is disposed on the second end, such that ends are configured to removably secure to one another to form a closed loop. In some embodiments, a reflective layer 610 is disposed along a length of the exterior of a secondary strap. In this way, the travel strap system 1000 is configured to alert passersby of the existence of a traveler or luggage when traveling in poorly lit areas. In some embodiments, a D-ring 510 is disposed on the secondary strap or other strap of the travel strap system 1000 in order to secure clips and rings, such as keyrings, thereto.

In the illustrated embodiment, the band attachment member 800 is secured to an end of an interior side of the secondary strap 200, 500, 600, 700. The band attachment member 800 comprises arms that are removably securable to one another such that a loop is formed and thereby cooperative secure objects, such as handles, cylinders, and the like, thereto. The arms of the loop attachment 800 comprise any suitable fastener, such as hook and loop material. In the shown embodiment, a center point defined between the two ends is permanently affixed to the strap via any suitable fastener, such as stitching. The loop attachment 800 is configured to secure around a rigid handle or rod, such as rolling luggage handle, for suspending the strap therefrom. In a closed position, the band attachment member 800 forms a channel that is oriented perpendicular to a length of the secondary strap 200, 500, 600, 700.

The accessory straps 300, 400 shown in FIG. 1, demonstrate two distinct accessory straps. The accessory straps 300, 400 are shown simultaneously in use in FIGS. 3 and 4. Generally, the accessory straps 300, 400 provide a means of securing the main strap 100 to a fixed object and orienting the secured objects thereto such that the objects are suspended therefrom. In the shown embodiment, a coupling strap 110 (also seen in FIG. 2) includes an adjustment member. The adjustment member provides for selective lengthening and shortening of the strap. Thereby, allowing the traveler to secure items of various sizes and shapes to the travel strap system 1000.

Figure 2:
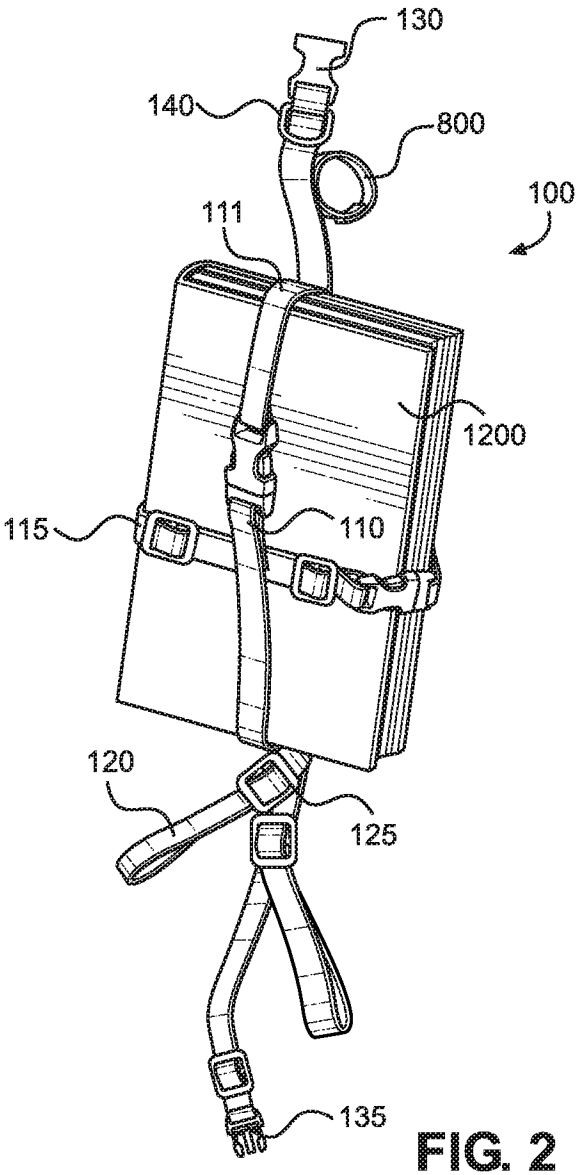
FIG. 2 shows a perspective view of the main strap of an embodiment of the travel strap system.

Referring now to FIG. 2, there is shown a perspective view of the main strap of an embodiment of the travel strap system in use. In the shown embodiment, a container strap 110 extends from the first end 130 of the main strap 100 and a coupling member 120 extends from the second end 135. The container strap 110 comprises a first crossmember 111 intersecting a second crossmember 115, wherein the crossmembers 111, 115 are configured to secure around a book 1200, tablet, or the like. A first end 112 of each crossmember 111, 115 is permanently secured to the main strap 100 and a second end 113 of each crossmember 111, 115 is permanently and perpendicularly secured to one another. The first end 112 of the first crossmember 111 is removably securable to the second end 113 thereof and the first end 112 of the second crossmember 115 is removably securable to the second end 113 thereof in order to form two intersecting and perpendicular loops are objects stored thereto. In the shown embodiment, each crossmember is adjustable in length via any suitable adjustment mechanism, such as a slide buckle.

In the shown embodiment, the coupling member 120 comprises a first and second closed loop each configured to receive an object, such as a coat or other article of clothing, therethrough. Each loop comprises a fastener that wraps the coupling member 120 to a portion of itself. The fastener is slidably engaged, such as a slide buckle 125, and configured to self-adjust a size of the loop to secure an item disposed therein automatically. This automatic adjustment occurs due to the weight of the object placed therein applying tension to the loop causing the fastener to slide so as to close the loop until the fastener is unable to slide any further. The first loop is disposed above the second loop, forming a stacked configuration.

Each end 130, 135 of the main strap 100 is configured to secure to a mating fastener. In the illustrated embodiment, a female buckle is disposed on the first end and a male buckle is disposed on the second end, such that ends are configured to removably secure to one another to form a loop. In the shown embodiment, a band attachment member 800 is disposed at the first end of the main strap 100 so as to allow the main strap to suspend from luggage and the like. In the illustrated embodiment, a D-ring is also secured to the first end of the main strap 100 for receiving clips and rings.

Figure 3:
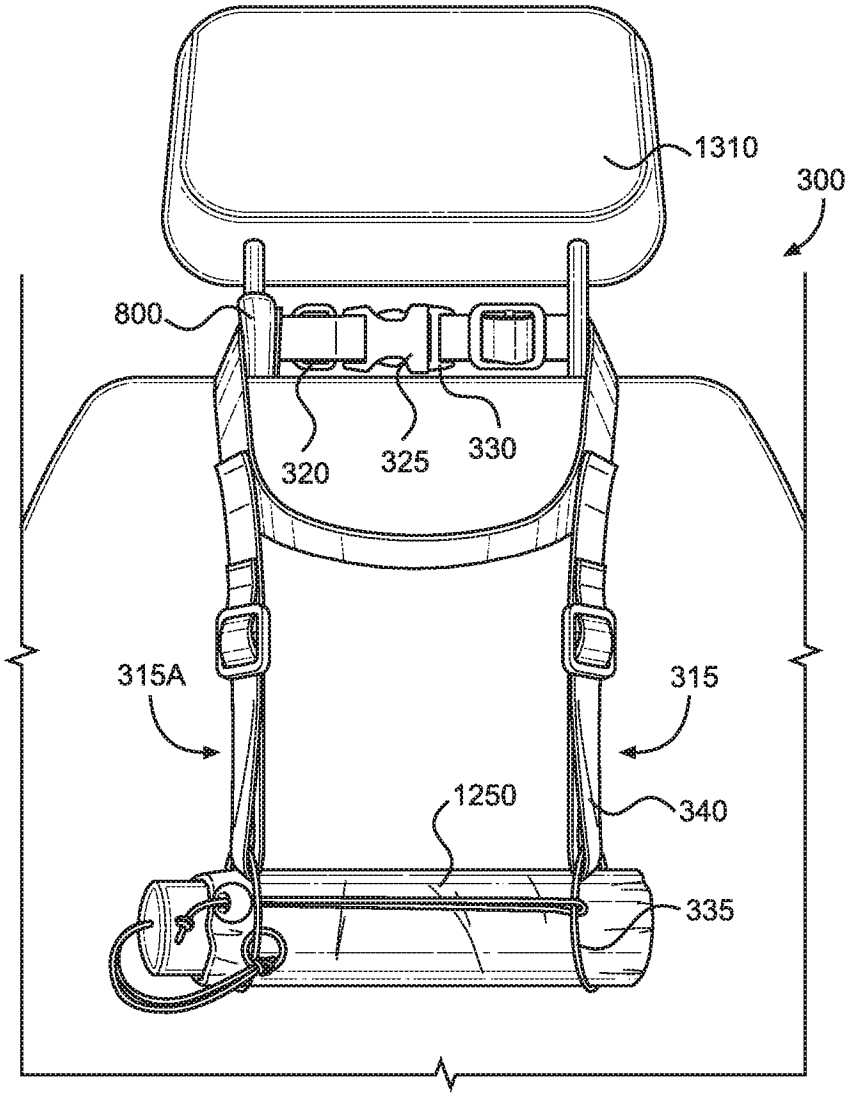
FIG. 3 shows a perspective view of the accessory strap of an embodiment of the travel strap system, wherein the accessory strap is secured to a car seat.
Figure 4:
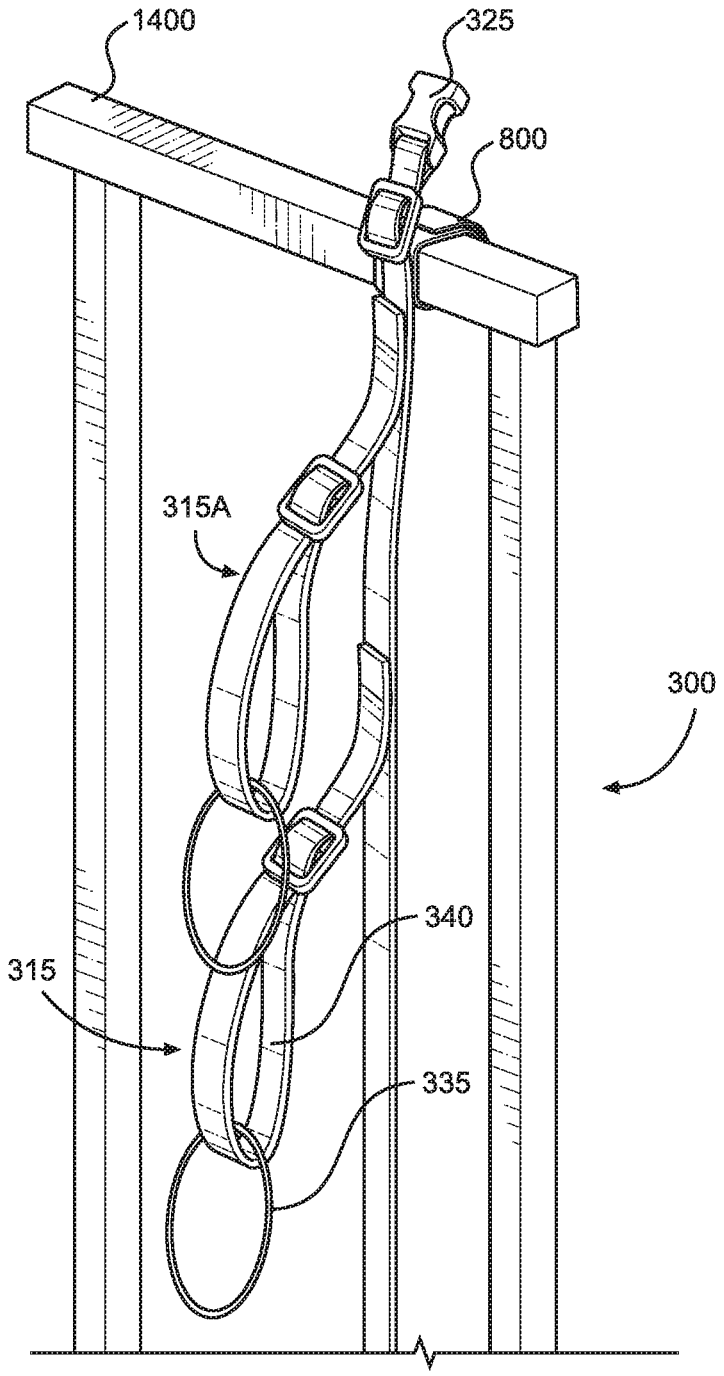
FIG. 4 shows a perspective view of the accessory strap of an embodiment of the travel strap system, wherein the accessory strap is secured to rolling luggage.

Referring now to FIGS. 3 and 4, there are shown perspective views of the embodiments of the accessory strap of the travel strap system, wherein the accessory strap of the embodiments are secured to rolling luggage and secured to a car seat, respectively. In the shown embodiment of FIG. 3, the accessory strap 300 includes a pair of coupling members 315, 315A suspended between a first end 325 and a second end 330 thereof. In some embodiments, each coupling member 315 forms a loop 340 that is coupled to a ring 335, wherein the ring 335 is freely movably along the loop 340. In some embodiments, the coupling member 315 only comprises a loop member 340, without the ring secured thereto (as seen in FIG. 1, 400). The first coupling member 315 is positioned adjacent to the first end 325 and the second coupling member 315A is positioned adjacent to the second end 330. In some embodiments, each coupling member 315, 315A is positioned equidistant between the ends of the accessory strap 300.

In the shown embodiments, the coupling member 800 is disposed at the first end of the accessory strap 300 in order to removably secure the accessory strap 300 to a handle 1400 of a piece of rolling luggage (as seen in FIG. 3) or to a car seat headrest 1310 (as seen in FIG. 4). The accessory strap 300 is configured to secure to another object in a first position and a second position. In the first position, the accessory strap 300 is suspended longitudinally from the first end thereof such that the first coupling member 315 is positioned above the second coupling member 315A, as shown in FIG. 4. In the second position, the first end and the second end of the accessory strap 300 are secured to one another laterally such that the pair of coupling members are parallel to one another, as shown in FIG. 3. In this way, an object (such as an umbrella 1250) can be positioned within the rings without risk of falling out while traveling.

Figure 5:
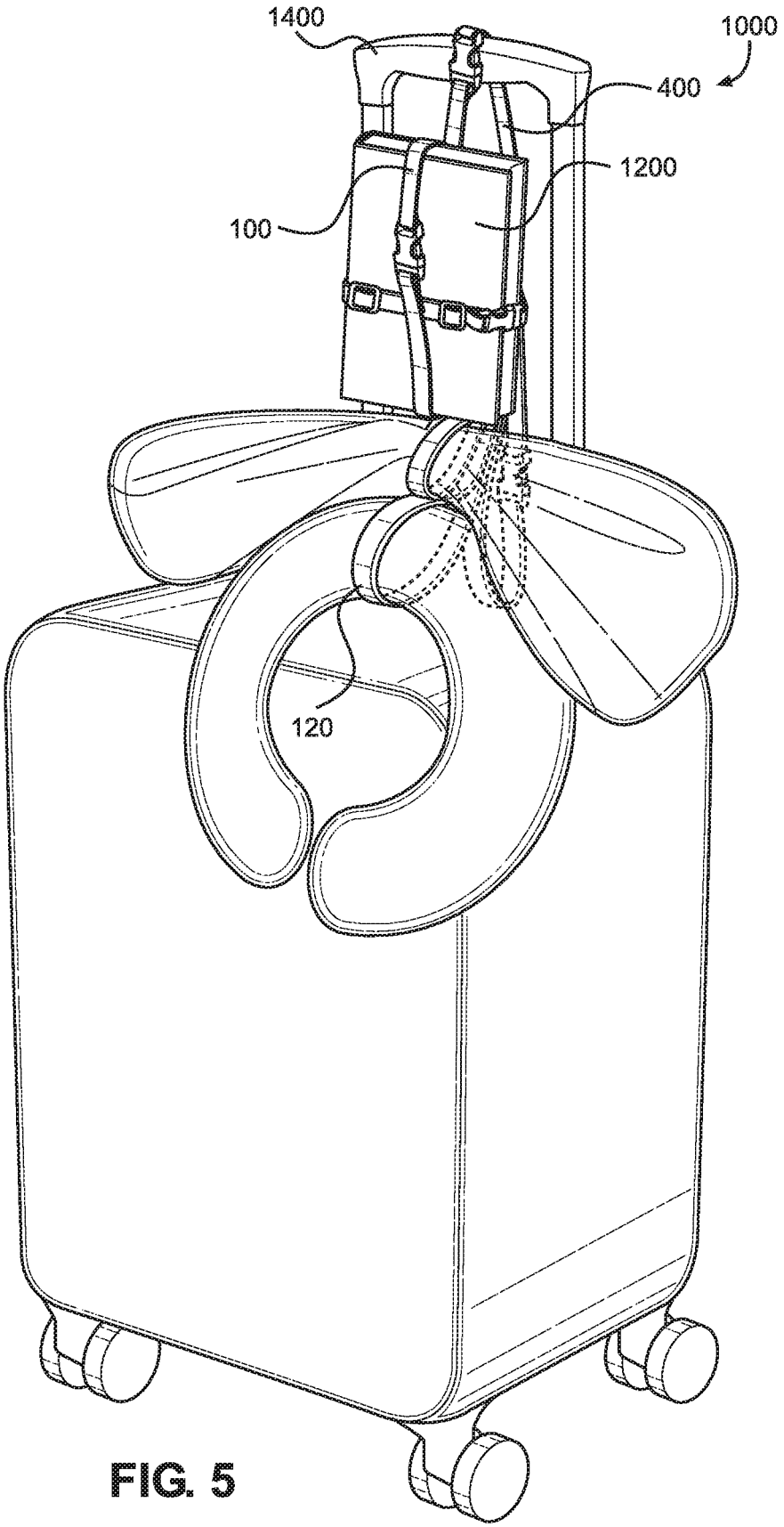
FIG. 5 shows a perspective view of an embodiment of the travel strap system in use.

Referring now to FIG. 5, there is shown a perspective view of an embodiment of the travel strap system in use. In operation, the travel strap system 1000 receives travel objects through the coupling members, loop members, container strap, and coupling members. The first end of the main strap 100 is attached to an object, such as the handle 1400 of rolling luggage, and an accessory strap 400 or secondary strap are attached to the second end of the main strap 100 so as to secure all travel items to one another. The straps are each configured to be suspended from any carry bags to provide security and worry-free movement. The travel strap system 1000 easily attaches personal items to a carry bag so as to maintain the personal items within reach without having to pack such items in a travel bag. For example, in the illustrated embodiment, a neck pillow is secured to the travel strap system 1000 via the coupling member 120. The user may remove the neck pillow during a flight without having to access the interior of the luggage. This is beneficial when traveling as access and to the luggage itself is limited and space to open the large compartment is prohibitive. The travel strap system 1000 is configured to reduce the risk of losing items or having items fall on the ground. The length of each strap is adjustable so the straps can be adapted to the items to be received and secured thereto. In one embodiment, the travel strap system 1000 is secured to the luggage in at least two points. For example, the accessory strap 400 includes an attachment member 800 at a lower end thereof that is secured to a handle of the luggage. In this way, the travel strap system 1000 is restricted from twisting or otherwise freely moving about the luggage. Other accessories, such as key chains, carabiners, hot and cold beverage bottle holders, are configured to be suspended from each strap.

The travel strap system 1000 is unisex and adapted to use by users of all ages. In one embodiment, the components of the travel strap system 1000 are designed for any type of light or heavy duty uses. For example, the straps comprise increase thickness and width that allows for increase tension loading, and the fasteners are adapted to remain coupled under increased load.

It is therefore submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A travel strap system, comprising:

a main strap having a first end and a second end;

a container strap extending from the first end of the main strap, the container strap adapted to secure an object therein;

wherein the container strap comprises a first crossmember intersecting a second crossmember, wherein a first end of each of the first and second crossmembers are permanently secured to the main strap and wherein the first and second crossmembers are permanently and perpendicularly secured to one another;

wherein the first end of the first crossmember is also removably securable to the second end of the first crossmember and the first end of the second crossmember is also removably securable to the second end of the second crossmember, such that when the ends of the first and second crossmembers are secured thereto-gether they form two intersecting and perpendicular loops adapted to secure the object therein;

a first coupling members forming a loop, wherein the first coupling member extends the second end of the main strap, wherein the first coupling member is adapted to self-adjust a size of the loop to secure an item disposed therein;

wherein the first end and second end of the main strap are each adapted to secure to a secondary strap;

wherein the secondary strap further comprises a plurality of secondary straps each having a fastener disposed on a first end and second end thereof, wherein the fastener on the first end thereof is configured to secure to the fastener on the second end thereof;

an accessory strap having a second and third coupling member suspended between a first end of the accessory strap and a second end of the accessory strap;

wherein the second and third coupling members each form a loop having a ring disposed therein, wherein the ring is freely movably along the loop member;

wherein the accessory strap is configured to secure to another object in a first position and a second position;

wherein the first position, the accessory strap is suspended longitudinally from the first end thereof such that the first coupling member is positioned above the second coupling member;

wherein the second position, the first end and the second end of the accessory strap are secured to one another laterally such that the pair of coupling members are parallel to one another.

2. The travel strap system of claim 1, wherein the first crossmember and the second crossmember is adapted to enclose a book in a closed configuration.

3. The travel strap system of claim 1, wherein the main strap is adjustable in length.

4. The travel strap system of claim 1, wherein each of the loop members are adjustably in size.

5. The travel strap system of claim 1, further comprising a reflective layer disposed along a length of a secondary strap of the plurality of secondary straps.

6. The travel strap system of claim 1, further comprising a band attachment secured to an interior side of the accessory strap, wherein the band attachment comprises a band strap, the band strap further comprising a pair of arms removably securable to one another such that a loop is formed and thereby cooperative secure about a luggage handle;

wherein the band attachment member forms a channel that is oriented perpendicular to a longitudinal axis of the accessory strap.

7. The travel strap system of claim 1, wherein the first crossmember is parallel to the main strap and the second crossmember is perpendicular to the main strap.

* * * * *